US005920931A

United States Patent [19]

Zuehlke et al.

[11] Patent Number: 5,920,931

[45] Date of Patent: Jul. 13, 1999

[54] PILLOW BLANKET

[76] Inventors: Christine Zuehlke; Angie J. School, both of 227 N. Washington, Berlin, Wis. 54923

[21] Appl. No.: 08/916,113

[22] Filed: Aug. 21, 1997

Related U.S. Application Data

[51] Int. Cl.[6] ..... A47G 9/06

[52] U.S. Cl. ..... 5/419; 5/428; 5/485; 5/490; 5/653

[58] Field of Search ..... 5/417, 419, 420, 5/482, 485, 490, 502, 653

[56] References Cited

U.S. PATENT DOCUMENTS

| | | | |
|---|---|---|---|
| 1,871,003 | 8/1932 | Longletz et al. | 5/420 X |
| 2,045,784 | 6/1936 | Leve | 5/419 |
| 2,183,418 | 12/1939 | Williams | 5/502 X |
| 2,898,609 | 8/1959 | Storie | 5/419 |
| 4,101,994 | 7/1978 | Hoyt | 5/419 |
| 4,375,111 | 3/1983 | Hall | 5/420 X |
| 4,634,618 | 1/1987 | Greer et al. | 5/417 X |
| 5,172,440 | 12/1992 | Ming | 5/419 X |
| 5,244,278 | 9/1993 | Robitaille | 5/417 X |
| 5,346,308 | 9/1994 | Buhot et al. | 5/417 X |
| 5,390,381 | 2/1995 | LaMantia | 5/485 X |
| 5,404,600 | 4/1995 | DeMars | 5/420 X |
| 5,454,125 | 10/1995 | Ratkowski | 5/419 X |
| 5,457,829 | 10/1995 | Elliott | 5/490 X |
| 5,463,783 | 11/1995 | Pope | 5/419 X |
| 5,774,912 | 7/1998 | Dominique | 5/419 |
| 5,785,219 | 7/1998 | Kraft | 5/419 X |

*Primary Examiner*—Brian K. Green
*Assistant Examiner*—Robert G. Santos
*Attorney, Agent, or Firm*—Michael I. Kroll

[57] ABSTRACT

A pillow blanket (10) comprising a broad flat pliable sheet (12) and a pocket member (14) onto the broad flat pliable sheet (12) at one corner (18), with an open mouth (20) of the pocket member (14) facing inwardly on the broad flat pliable sheet (12). In a first instance, the broad flat pliable sheet (12) when unfolded can be utilized as a blanket. In a second instance, the broad flat pliable sheet (12) when folded up and tucked into the open mouth (20) of the pocket member (14) after the pocket member (14) is turned inside out can be utilized as a pillow and seat cushion.

3 Claims, 4 Drawing Sheets

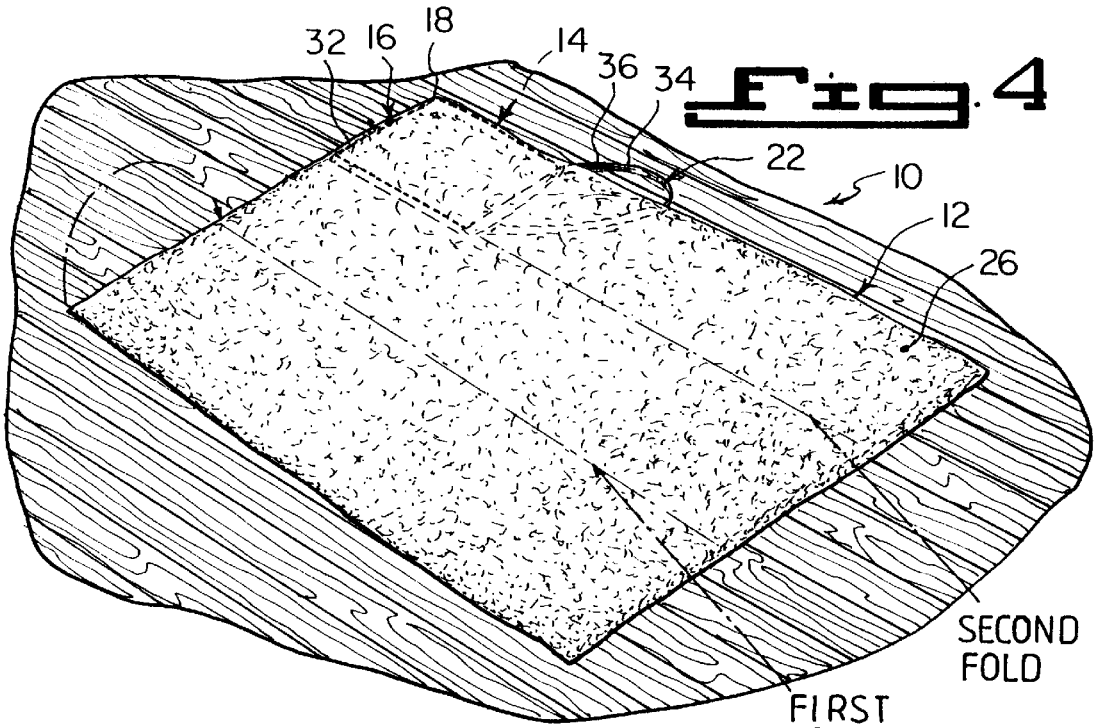
Fig. 4
Fig. 5
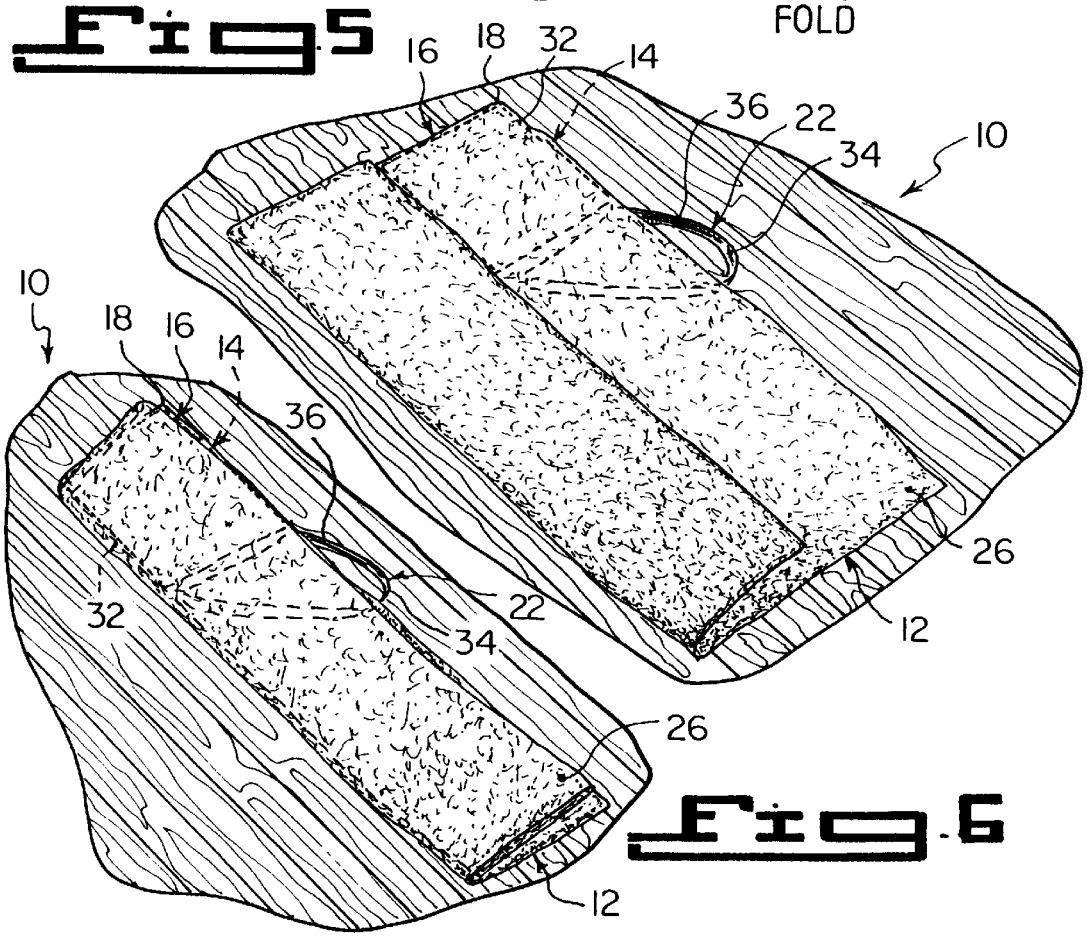
Fig. 6

PILLOW BLANKET

BACKGROUND OF THE INVENTION

1. Field of the Invention

The instant invention relates generally to comforters and more specifically it relates to a pillow blanket. The pillow blanket consists of a fleece blanket with a pocket at one corner. The fleece blanket can be folded up and tucked into the pocket to be used as a pillow or seat cushion when needed. It also is provided with a detachable carry handle, so that it can be conveniently carried over the shoulder of a person when in its pillow state.

2. Description of the Prior Art

Numerous comforters have been provided in prior art. For example, U.S. Pat. Nos. 4,991,245 to Franco; 5,103,515 to Bird; 5,172,440 to Ming; 5,421,045 to Bowen; 5,454,125 to Ratkowski; 5,457,829 to Elliott and 5,481,768 to Shink all are illustrative of such prior art. While these units may be suitable for the particular purpose to which they address, they would not be as suitable for the purposes of the present invention as heretofore described.

A portable lounge/pillow, the lounge portion being made of a sheet material such as plastic or fabric, is convertible to and from a tote bag for carrying articles by folding portions of a sheet over and upon one another about transverse and longitudinal folds to form interior article-holding compartments. Carrying handles are positioned in registry with each other after folding of the sheet portions, and serve as a convenient hand-grip for carrying the articles. A cover sheet is detachably mounted on a sheet such as a fabric sheet for user comfort. A strap hanger enables the lounge/pillow set to be supportably suspended for air drying. Additional article-holding pockets are formed in the sheet for increased carrying capacity. A device for securing the lounge/pillow in a roll without having to deflate the pillow may be provided.

A lightweight blanket with insulating properties being made of a sheet of pliable material and having a number of internal pockets, is convertible to and from a tote by folding portions of the sheet over and upon one another about transverse and logical folds. Carrying handles are positioned in registry with one another and fastened together after folding the sheet portions and used as a convenient grip for carrying the tote.

A quilt bag comprising a frontal section patterned after a toy and sewn to a cover of a quilt and integral with flap or back section equal in size to the frontal section and a zip-fastener affixed to margins of the frontal and back sections to zip closed a bag constituted with the frontal and the back sections for loading the quilt in good order and appearance.

A soft sculpture which is convertible to a blanket with a pillow, having a hollow body portion including an opening for receiving and storing a blanket therein. The blanket being substantially enclosed within the body portion to form a three-dimensional toy. The blanket may be removably or fixably attached to the body portion and is removable through the opening of the body portion for use as bedding. The blanket further includes a pocket having an opening for receiving the soft sculpture therein to form a pillow. The body portion may be embellished with a head portion having an image bearing surface and appropriate appendages and a pocket for receiving a book.

A self-contained comfort device having a generally rectangular body portion and two pocket members disposed one on each surface of the body portion for containing the device when the device is folded and the pocket member is inverted thereabout. A generally rectangular resilient pad is incorporated within one of the pocket members. Preferably, the device is made with fleece on one surface and water-resistant material on the other. Customized logos may also be imprinted or embroidered on either surface.

An improved comforter having a pocket which is permanently secured to one side thereof in a position located substantially centrally along one side edge, and which pocket is shaped and dimensioned so as to be turned inside out and have the comforter folded, rolled and tucked into the inside out pocket to form a standard size pillow, without utilizing fastening means, and which will fit into a standard size pillow case.

A blanket that can be converted into a pillow. The blanket has a pair of straps which can secure the blanket in a folded position.

SUMMARY OF THE INVENTION

A primary object of the present invention is to provide a pillow blanket that will overcome the shortcomings of the prior art devices.

Another object is to provide a pillow blanket that can be selectively used as a blanket, a seat cushion, a pillow and as a tote bag with a detachable carry handle, to hold and carry various useful articles therein.

An additional object is to provide a pillow blanket in which the blanket is fabricated out of a fleece material, which is known for its wearability and comfort, since it is soft yet durable and easy to care for.

A further object is to provide a pillow blanket that is simple and easy to use.

A still further object is to provide a pillow blanket that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Figure 1:
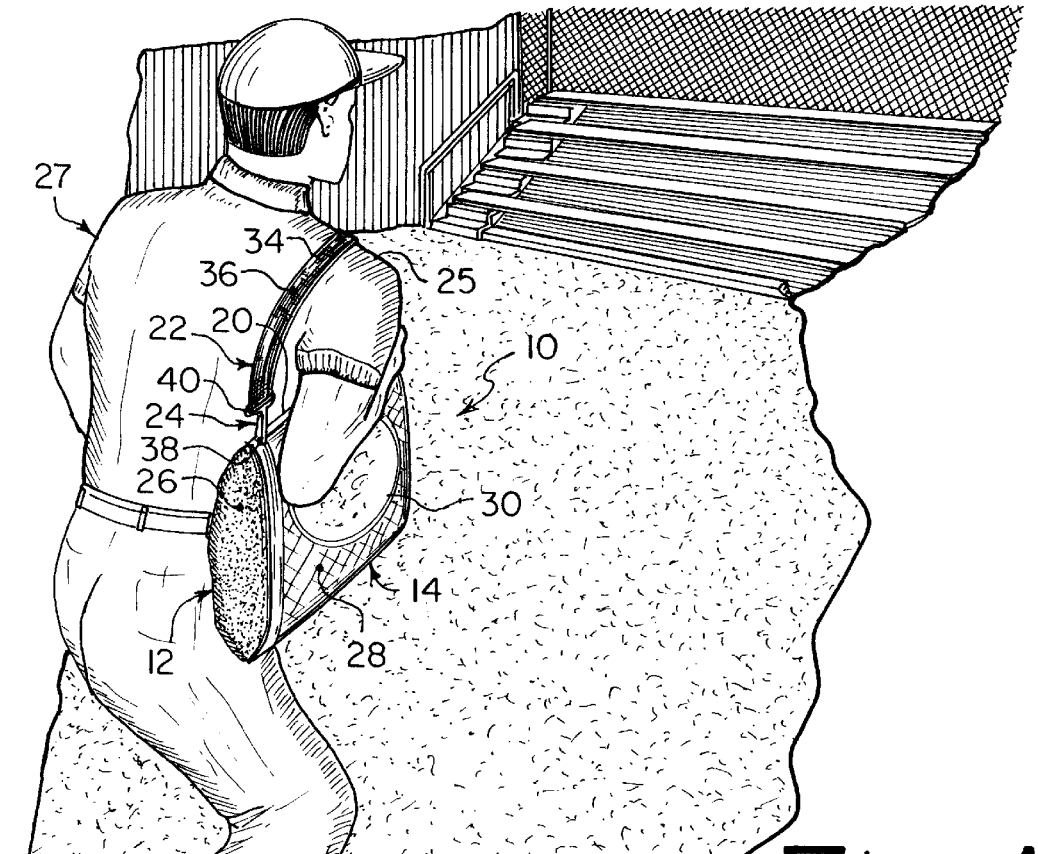
FIG. 1 is a perspective view of the instant invention folded up being carried by a person towards sport stadium seats.
Figure 2:
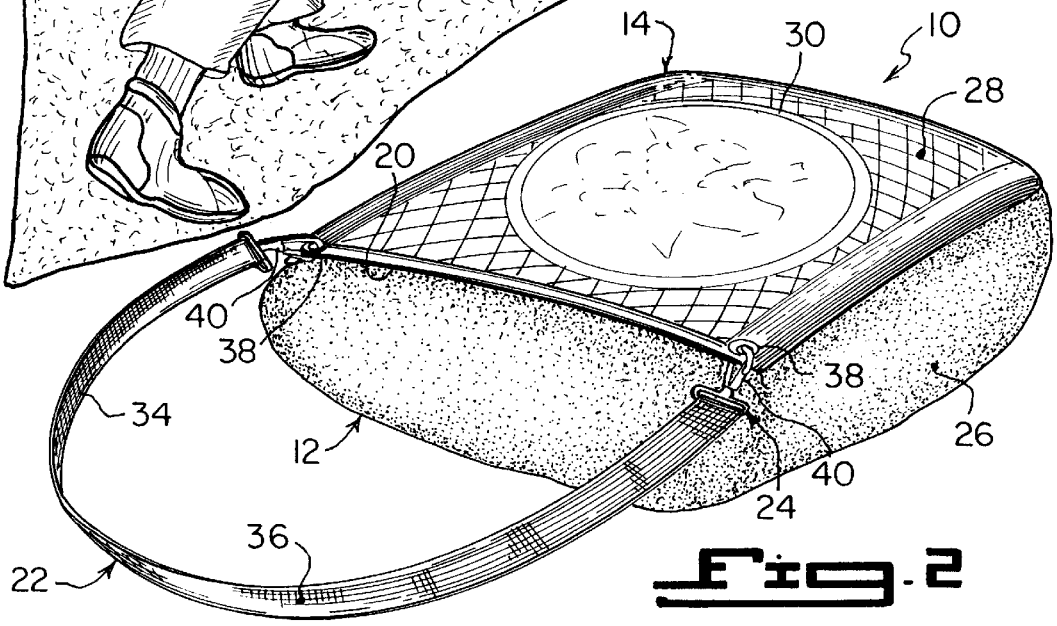
FIG. 2 is a perspective view of the instant invention per se folded up.
Figure 3:
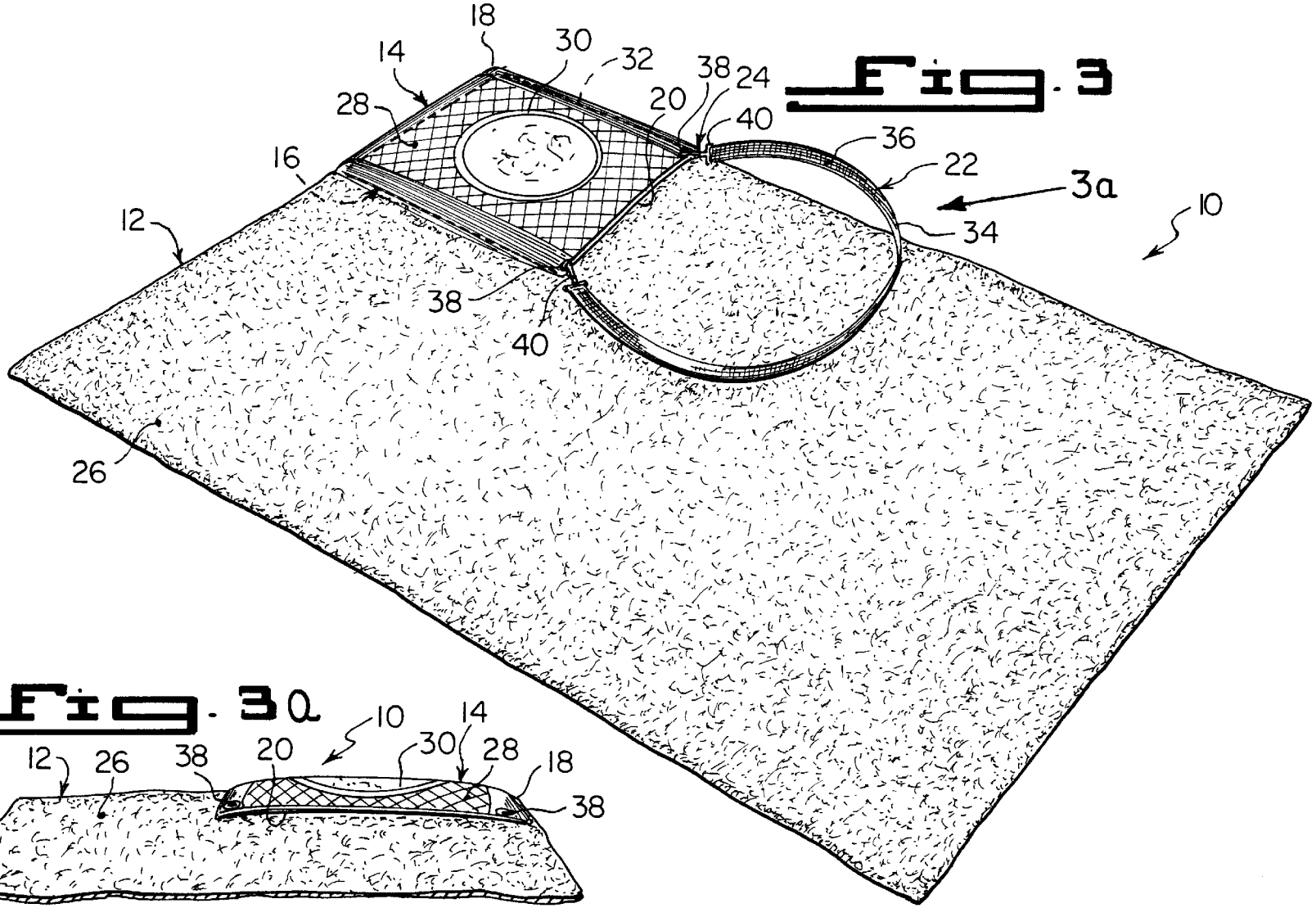
FIG. 3 is a top perspective view of the instant invention fully unfolded.
Figure 3A:
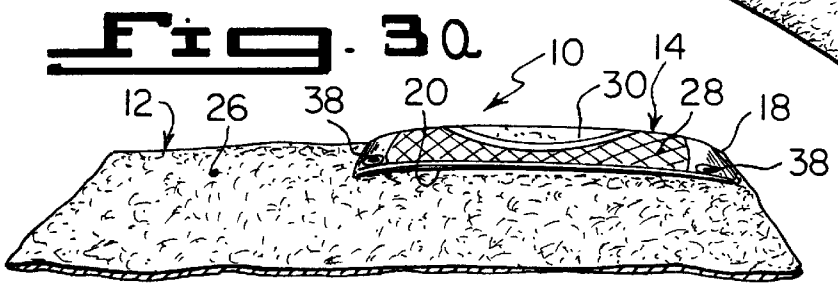

FIG. 3*a* is a top perspective view taken in the direction of arrow 3*a* in FIG. 3, looking into the pocket with the fleece blanket broken away and the detachable carry handle removed therefrom.

FIG. 4 is a bottom perspective view of the instant invention fully unfolded and placed upon a flat surface.

FIG. 5 is a bottom perspective view similar to FIG. 4, with the fleece blanket in a first fold.

FIG. 6 is a bottom perspective view similar to FIG. 5, with the fleece blanket in a second fold.

Figure 7:
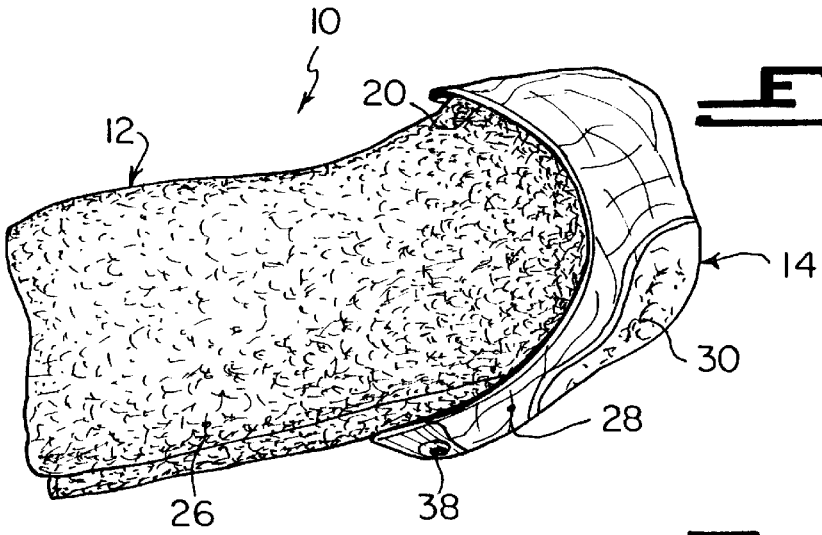

FIG. 7 is a bottom perspective view, showing the pocket being turned inside out and the fleece blanket broken away and the detachable carry handle removed therefrom.

Figure 8:
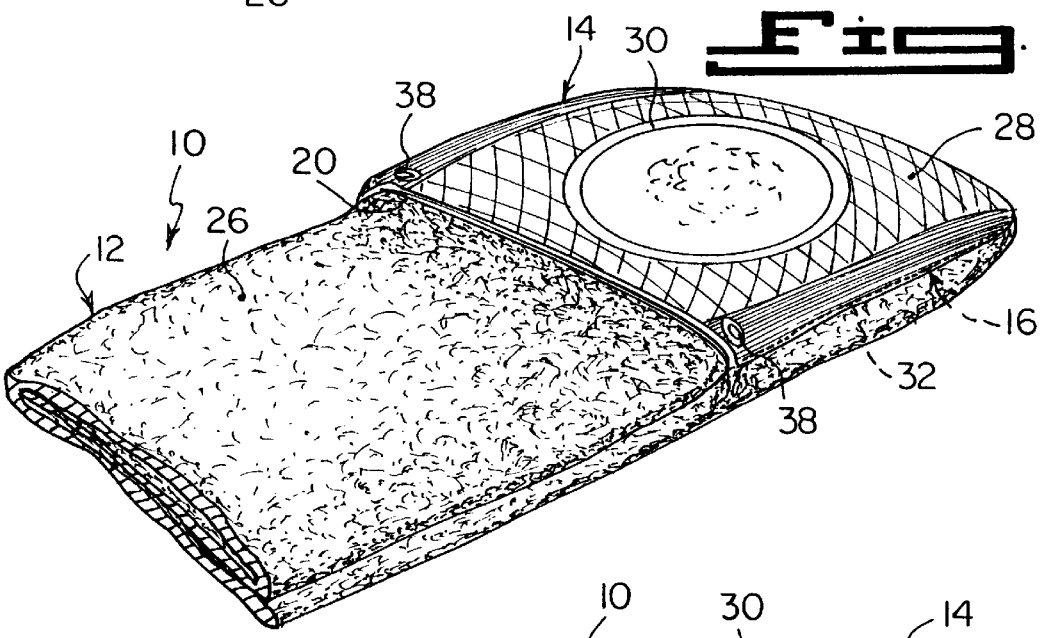

FIG. 8 is a bottom perspective view similar to FIG. 7, with the pocket turned inside out.

Figure 9:
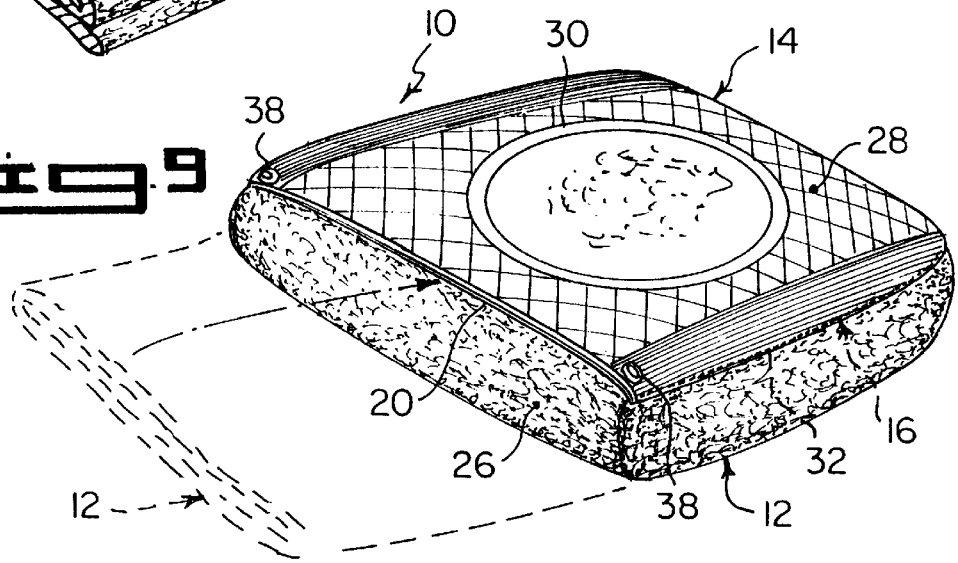

FIG. 9 is a bottom perspective view similar to FIG. 8, with the fleece blanket tucked into the pocket.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 through 9 illustrate a pillow blanket 10 of the present invention. With regard to the reference numerals used, the following numbering is used throughout the various drawing figures.

| | |
|---|---|
| 10 | pillow blanket |
| 12 | broad flat pliable sheet of 10 |
| 14 | pocket member of 10 |
| 16 | attaching facility of 10 |
| 18 | corner of 12 |
| 20 | open mouth of 14 |
| 22 | carry handle of 10 |
| 24 | connectinq assembly of 10 |
| 25 | shoulder of 27 |
| 26 | fleece material for 12 |
| 27 | person |
| 28 | piece of cloth material for 14 |
| 30 | decorative pattern on 28 |
| 32 | thread of 16 |
| 34 | elongate strap for 22 |
| 36 | webbing material for 34 |
| 38 | eyelet of 24 on 14 |
| 40 | spring catch of 24 on 34 |

The pillow blanket 10 comprises a broad flat pliable sheet 12 and a pocket member 14. A facility 16 is for attaching the pocket member 14 onto the broad flat pliable sheet 12 at one corner 18, with an open mouth 20 of the pocket member 14 facing inwardly on the broad flat pliable sheet 12. In a first instance, as shown in FIGS. 3, 3*a* and 5, the broad flat pliable sheet 12 when unfolded can be utilized as a blanket. In a second instance, as shown in FIG. 9, the broad flat pliable sheet 12 when folded up and tucked into the open mouth 20 of the pocket member 14 after the pocket member 14 is turned inside out can be utilized as a pillow and seat cushion.

The pillow blanket 10, shown in FIGS. 1 through 3 and 4 through 6, further include a carry handle 22 and an assembly 24 for connecting the carry handle 22 in a detachable manner to the pocket member 14. When the broad flat pliable sheet 12 is folded up and tucked into the open mouth 20 of the pocket member 14, the carry handle 22 can be carried on a shoulder 25 of a person 27, with the pocket member 14 utilized as a tote bag to hold various useful and personal articles therein.

The broad flat pliable sheet 12 is fabricated out of a fleece material 26. The broad flat pliable sheet 12 is approximately 72 by 60 inches in size.

The pocket member 14 is fabricated out of a piece of cloth material 28. The piece of cloth material 28 contains a decorative pattern 30 thereon, to enhance the appearance of the pocket member 14. The piece of cloth material 28 is dimensioned to be of a size, so that when attached to the broad flat pliable sheet 12 as the pocket member 14 and turned inside out, it will receive and hold the broad flat pliable sheet 12 when the broad flat pliable sheet 12 is folded up and tucked into the open mouth of the pocket member 14, as shown in FIGS. 4 through 9.

The attaching facility 16 consists of securing, by securing with thread, 32 three sides of the pocket member 14 onto the broad flat pliable sheet 12 at the corner 18, with the fourth side not sewn, so as to form the open mouth 20 of the pocket member 14 facing inwardly on the broad flat pliable sheet 12.

The carry handle 22 is an elongate strap 34 fabricated out of a webbing material 36. The connecting assembly 24 includes the pocket member 14 having a pair of eyelets 38. Each eyelet 38 is located at a corner thereof adjacent the open mouth 20. A pair of spring catches 40 are provided. Each spring catch 40 is located at one end of the elongate strap 34, so as to engage with one eyelet 38 on the pocket member 14.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A pillow blanket comprising:

a) a broad flat pliable sheet of fleece material in rectangular shape approximately 72 by 60 inches in size having two parallel fold lines parallel to opposite sides of said sheet and dividing said sheet into approximately three equal segments;

b) a rectangular pocket member of cloth material;

c) said pocket member being affixed to said sheet in one corner of said sheet with one side having an open mouth facing inwardly and three closed sides sewn on said sheet with two of said closed sides sewn along two corner edges of said sheet and the third closed side co-extensive with one of said fold lines, said pocket member being dimensioned so that when turned inside out it will receive said sheet when said sheet is folded up along both said fold lines on the side of said sheet opposite said pocket member and tucked into said open mouth of said pocket member;

d) means comprising a carry handle strap of webbing material connected in a detachable manner to said pocket member in which said pocket member has a pair of eyelets, each eyelet located at a corner of said pocket member adjacent opposite ends of said open mouth and a pair of spring catches, each spring catch located at one end of said strap to engage an eyelet on said pocket member.

2. A pillow blanket as recited in claim 1, wherein said piece of cloth material includes a decorative pattern thereon to enhance the appearance of said pocket member.

3. The method of folding a rectangular blanket of fleece material comprising the steps of:

a) placing a broad flat pliable sheet of fleece material in rectangular shape on a flat horizontal surface, said sheet having a rectangular pocket member of cloth material on the underside of said sheet, said pocket member being affixed to said sheet in one corner of said sheet with one side having an open mouth facing inwardly and three closed sides sewn on said sheet with two of said closed sides sewn along two corner edges of said sheet, the edge of said sheet along said pocket member adjacent said open mouth being the proximate edge of said sheet, said sheet having first and second parallel fold lines in which the first of said fold lines runs along the third closed side of said pocket and the second of said fold lines is located about halfway between said third closed side of said pocket and the distal edge of said sheet, said fold lines dividing said sheet into three approximately equal segments;

b) folding said sheet up along said second fold line and placing the distal edge of said sheet along said first fold line;

c) folding said sheet up along said first fold line forming three folded layers of said sheet on the side of said sheet opposite said pocket member;

d) turning said pocket member inside out to fold and tuck said sheet into said pocket member through the open mouth thereof; and e) attaching a carry handle strap of webbing material in a detachable manner to said pocket member in which said pocket member has a pair of eyelets, each eyelet located at a corner of said pocket member adjacent opposite ends of said open mouth and a pair of spring catches, each spring catch located at one end of said strap to engage an eyelet on said pocket member.

* * * * *